US006692266B2

(12) United States Patent
Hashiguchi et al.

(10) Patent No.: US 6,692,266 B2
(45) Date of Patent: Feb. 17, 2004

(54) SURFACE-MOUNTABLE CONNECTOR WITH STRUCTURE PERMITTING TO EASILY CHECK FLATNESS OF CONTACT TERMINALS BY USE OF A GAUGE AND THE GAUGE

(75) Inventors: Osamu Hashiguchi, Akishima (JP); Takeshi Shindo, Higashiyamato (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 10/352,445

(22) Filed: Jan. 28, 2003

(65) Prior Publication Data

US 2003/0143874 A1 Jul. 31, 2003

(30) Foreign Application Priority Data

Jan. 29, 2002 (JP) ..... 2002-019464

(51) Int. Cl.[7] ..... H01R 12/22
(52) U.S. Cl. ..... 439/74; 439/733.1
(58) Field of Search ..... 439/74, 83, 733.1, 439/869, 81, 775, 776, 625

(56) References Cited

U.S. PATENT DOCUMENTS 5,885,092 A * 3/1999 Ito et al. ..... 439/74
5,975,916 A * 11/1999 Okura ..... 439/74
6,135,785 A * 10/2000 Niitsu ..... 439/74
6,250,935 B1 * 6/2001 Mochizuki et al. ..... 439/74
6,276,942 B1 * 8/2001 Hsiao ..... 439/74

* cited by examiner

*Primary Examiner*—P. Austin Bradley
*Assistant Examiner*—Briggitte R Hammond
(74) *Attorney, Agent, or Firm*—Michael Best & Friedrich LLP

(57) ABSTRACT

A connector (1) comprises an insulator (2) and four rows of contacts (3). The insulator (2) has a shape of an almost rectangular parallelepiped and has two cut-off like shaped edges (2B) and a groove (2C). The cut-off like shaped edges (2B) are provided on a lower side in an X-direction and on opposite sides in a Y-direction perpendicular to the X-direction. The groove (2C) is provided on a lower surface (2F) of the insulator (2). The cut-off like shaped edges (2B) and the groove (2C) straightly extend in a Z-direction perpendicular to the X- and Y-directions. Each of the contacts (3) has a curved portion (3B) and a flat terminal end portion (3C). The curved portions (3B) and the flat terminal end portions (3C) of the contacts (3), which belong to two rows nearest the side surfaces (2E), are positioned within the cut-off like shaped edges (2B). The other curved portions (3B) and the other flat terminal end portions (3C) are positioned within the groove (2C). All of the flat terminal end portions (3C) are normally on the same level. To check this, the gauge (6) is used. During the check, the connector (1) is slid on the upper surface (6A) of the gauge while the flat terminal end portions (3C) are inserted into the respective gaps (6B2, 6C2, 6D2, 6D4) of the gauge (6). If one of the flat terminal end portions (3C) collides with side projections (6B1, 6C1, 6D1, 6D3) of the gauge (6), the connector (1) is judged as a defective one.

6 Claims, 8 Drawing Sheets

SURFACE-MOUNTABLE CONNECTOR WITH STRUCTURE PERMITTING TO EASILY CHECK FLATNESS OF CONTACT TERMINALS BY USE OF A GAUGE AND THE GAUGE

BACKGROUND OF THE INVENTION

The present invention relates to a surface mountable connector having three or more rows of contacts. The present invention also relates to a physical gauge for check whether all terminals of the contacts in the connector are flat or on the same level or not.

A connector is known which is directly mounted for example on a printed circuit board. Such a connector is called a surface mountable connector or a surface mounted connector.

There is a surface mountable connector which has three or more rows of contacts. All terminal ends of the contacts or contact terminals in the connector, which are fixedly connected to circuit patterns on the printed circuit board by soldering, should be flat or on the same level to ensure reliable connection with the printed circuit board.

However, for a connector having three or more rows of contacts, there was no physical gauge which could check whether all terminal ends of the contacts were on the same level. Also a connector was not designed in consideration of the check with a physical gauge. Conventionally, an optical instrument was therefore used in the check of the arrangement of the contacts. Such an optical instrument is expensive and the check with the optical instrument takes a lot of time.

SUMMARY OF THE INVENTION

It is therefore an object of the present invention to provide a surface mountable connector which is designed in consideration of the check with a physical gauge and to provide a gauge which can be used in the check whether all terminal ends of contacts in a connector are on the same level.

According to this invention, there is provided a connector (1), which comprises:

an insulator (2) in a shape of a rectangular parallelepiped having a lower surface (2F) on a lower side in a first direction and two side surfaces (2E) in a second direction perpendicular to the first direction, the insulator (2) having two cut-off like shaped edges (2B) on the lower side in the first direction and on both sides in the second direction, and further having at least one groove (2C) on the lower surface (2F), the cutoff like shaped edges (2B) and the at least one groove (2C) straightly extending in a third direction perpendicular to the first and second direction; and three or more rows of contacts (3) fixedly mounted on the insulator, each of the contacts (3) having a contact portion (3D), a connection portion (3A), which continues from the contact portion (3D), a curved portion (3B), which continues from the connection portion (3A) and projects towards a side of the contact portion (3D), and a flat terminal end portion (3C), which continues from the curved portion (3B), wherein the flat terminal end portions (3C) of the contacts (3) are on the same level, and wherein the curved portions (3B) and the flat terminal end portions (3C) of the contacts (3), which belong to two rows nearest the side surfaces (2E), are positioned within the cut-off like shaped edges (2B), while the other curved portions (3B) and the other flat terminal end portions (3C) are positioned within the at least one groove.

In the connector (1), the flat terminal end portions (3C) of the contacts (3), which belong to the two rows nearest the side surfaces (2E), may lie inside the side surfaces (2E) in the second direction.

In the connector (1), each of the cut-off like shaped edges (2B) may have at least one beveled edge (2B1), which extends from a corresponding one of the side surfaces (2E) toward corresponding ones of the curved portions (3B), and the at least one groove (2C) has a bottom (2C4) and at least one beveled portion (2C3), which extends from the bottom (2C4) toward corresponding ones of the curved portions (3B).

In the connector (1), the beveled edges (2B1) of the cut-off like shaped edges (2B) and the beveled portion (2C3) may define imaginary triangle spaces together with the respective curved portions (3B) and the respective flat terminal end portions (3C).

In an embodiment of the connector (1), each of the cut-off like shaped edges (2B) further has a first surface (2B2), which continues from the beveled edge (2B1) and is parallel to the lower surface (2F), and a second surface (2B3), which connects between the first surface (2B2) and the lower surface (2F). The first and second surfaces (2B2, 2B3) define a space to accommodate corresponding ones of the curved portions (3B). The at least one groove (2C) further has a first portion (2C2), which continues from the beveled portion (2C3) and is parallel to the lower surface (2F), and a second portion (2C1), which connects between the first portion (2C2) and the lower surface (2F). The first and second portions (2C2, 2C1) define a space to accommodate corresponding ones of the curved portions (3B).

According to the present invention, there is further provided a gauge (6) for checking whether the flat terminal end portions (3C) in the connector (1) of this invention are on the same level. The gauge comprises:

an upper surface (6A) on an upper side in the first direction, on which the connector is mounted during the check;

opposite side surfaces 6E in the second direction;

opposite-side projections (6B, 6C) provided on the upper surface (6A) at opposite sides in the second direction and projecting from the upper surface (6A) in the first direction, the opposite projections (6B, 6C) having hook-shaped cross sections which have lateral protrusions (6B1, 6C1) which go toward the inside of the opposite side surfaces (6E), respectively; and at least one intermediate projection (6D) provided on the upper surface (6A) at an intermediate position between the opposite-side projections (6B, 6C) and projecting from an upper surface (6A) in the first direction, the at least one intermediate projection (6D) corresponding to the at least one groove (2C) and having at least one hook-shaped cross-sectional portion which has a lateral protrusion (6D1, 6D3) which faces the respective contacts (3) when the check is carried out;

wherein:

the opposite-side projections (6B, 6C) and the at least one intermediate projection (6D) extend straightly in the third direction;

gaps (6B2, 6C2), which are defined by the upper surface (6A) and the side projections (6B1, 6C1) of the opposite-side projections (6B, 6C), are for accommodating the flat terminal end portions (3C) nearest the side surfaces (2E) of the connector (1) when the check is carried out;

another gap (6D2, 6D4), which is defined by the upper surface (6A) and the lateral projection (6D1, 6D3) of the at least one intermediate projection (6D), is for accommodating corresponding ones of the flat terminal end portions (3C) when the check is carried out; and the at least one intermediate projection (6D) is to be accommodated in the at least one groove (2C) of the connector (1) when the check is carried out.

DESCRIPTION OF PREFERRED EMBODIMENTS

Figure 1:
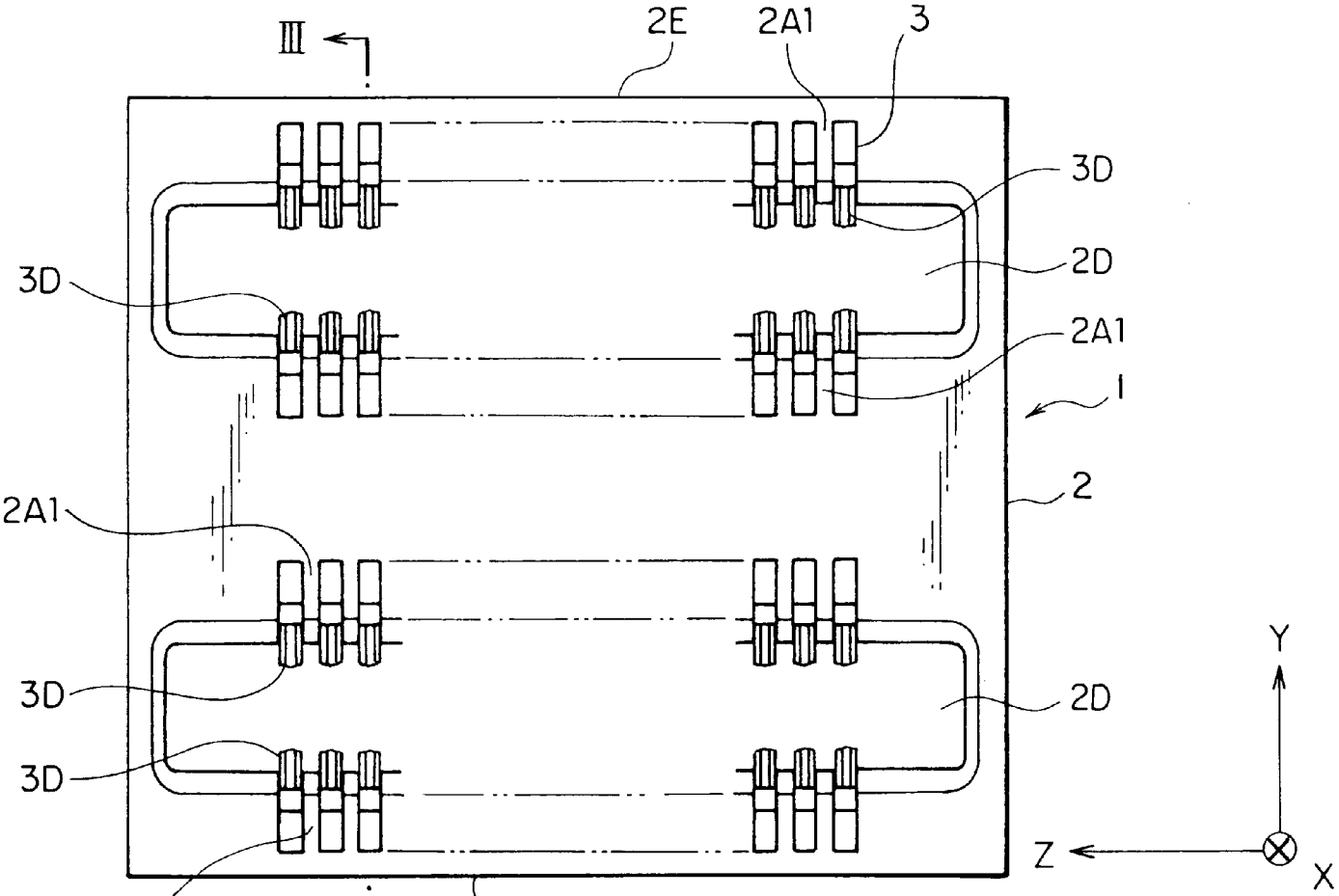
FIG. 1 is a top plan view showing a receptacle connector according to an embodiment of the present invention.
Figure 2:
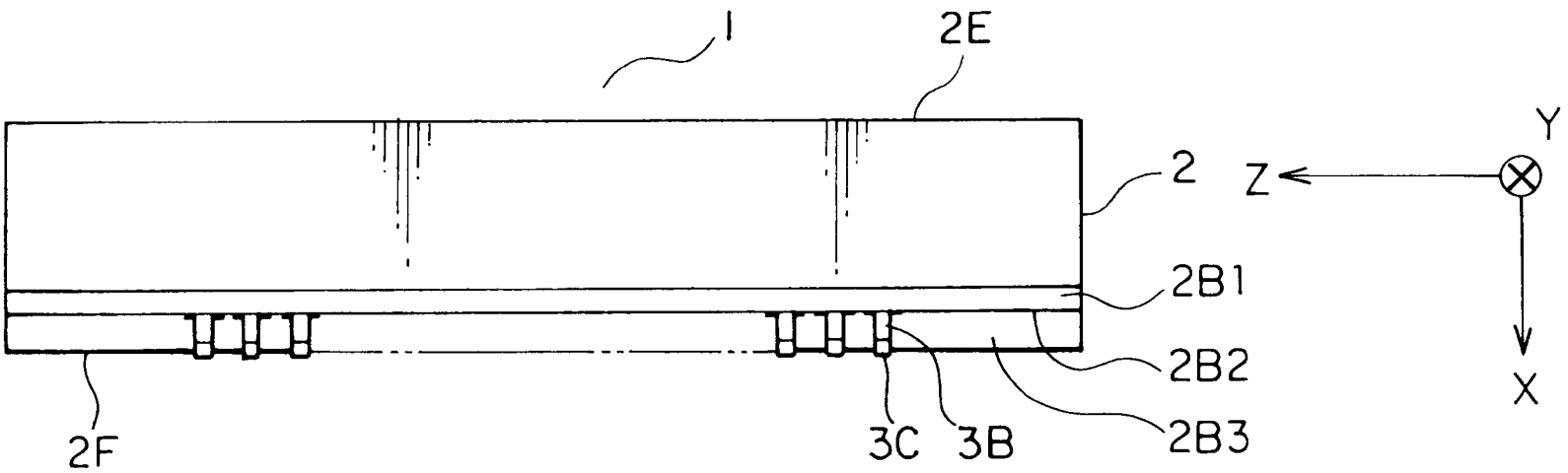
FIG. 2 is a side view showing the connector of FIG. 1.
Figure 3:
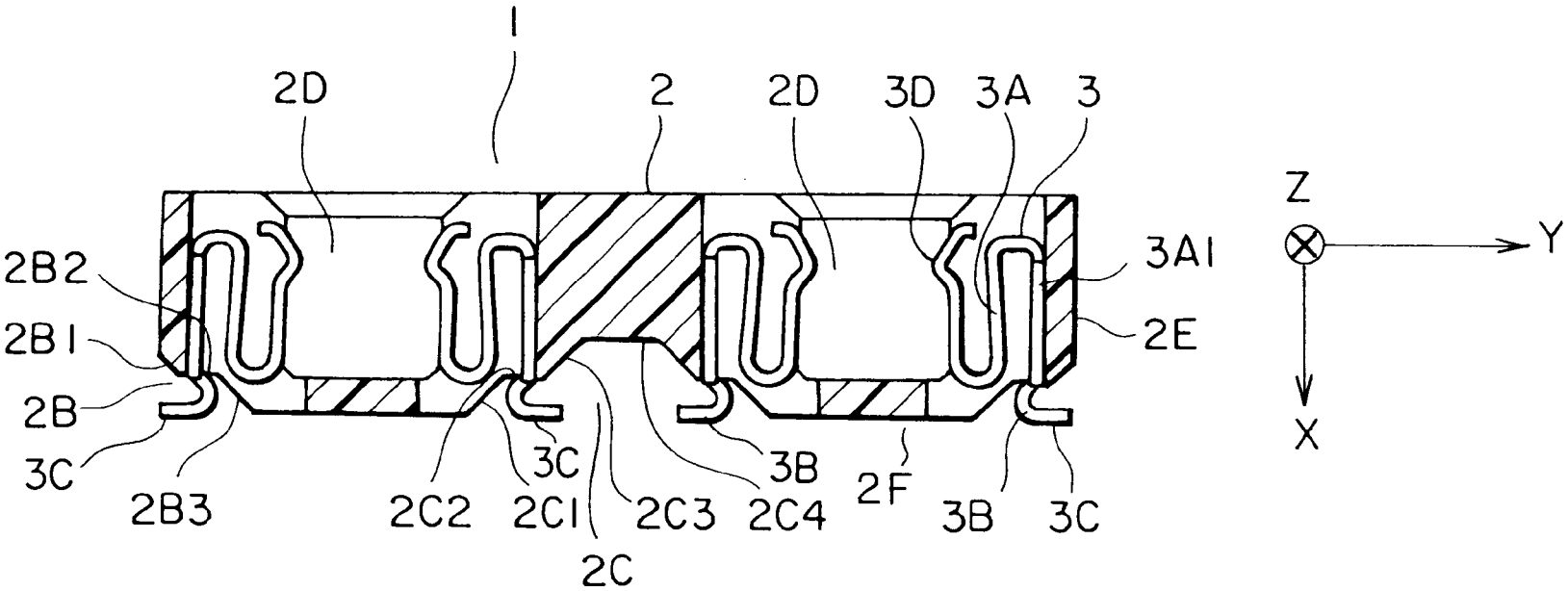
FIG. 3 is a cross-sectional view showing the connector taken along lines III—III of FIG. 1.

With reference to FIGS. 1 to 3, a receptacle connector 1 comprises an insulator 2 and a plurality of rows of contacts 3. In this embodiment, the number of rows of the contacts 3 is four.

The insulator 2 has a shape of an almost rectangular parallelepiped, which has a lower surface 2F on a lower side in an X-direction and two side surfaces 2E in a Y-direction perpendicular to the X-direction. The lower surface 2F is a surface to be mounted for example on a printed circuit board. The insulator 2 is provided with two large slots 2D in an upper surface thereof in the X-direction into which a plug connector is fit as a mating connector. The two large slots 2D extend in parallel with each other in a Z direction perpendicular to the X- and Y-directions and are spaced from each other in the Y-direction.

In detail, the insulator 2 has external forms of rectangular cross sections in two planes, one of which is defined by the X-direction and the Z-direction, while the other of which is defined by the Y- and Z-directions. The insulator 2 has a specific external form of a cross section in a plane defined by the X- and Y-directions, due to the followings.

As specifically shown in FIG. 3, the insulator 2 has two cut-off like shaped edges 2B and a groove 2C. The cut-off like shaped edges 2B are provided on the lower side in the X-direction and on opposite sides in the Y-direction. The groove 2C is provided on the lower surface 2F. The cut-off like shaped edges 2B and the groove 2C straightly extend in the Z-direction.

Each of the cut-off like shaped edges 2B has a beveled edge 2B1, a surface 2B2 and a surface 2B3. The beveled edge 2B1 extends from a corresponding one of the side surfaces 2E downwardly and toward the inside of the side surfaces 2E. The surface 2B2 continues from the beveled edge 2B1 and is parallel to the lower surface 2F. The surface 2B3 connects between the surface 2B2 and the lower surface 2F. In this embodiment, the surface 2B3 is also a beveled surface. The shape of each cut-off like shaped edge 2B can be expressed as a combined shape of two slopes and a staircase of a single step.

The groove 2C has a bottom 2C4, two beveled portions 2C3, two portions 2C2 and two portions 2C1. The beveled portions 2C3 extend from the bottom 2C4 downwardly and toward the respective side surfaces 2E. The portions 2C2 continue from the respective beveled portions 2C3 and are parallel to the lower surface 2F. The portions 2C1 connect between the respective portions 2C2 and the lower surface 2F. In this embodiment, the portions 2C1 have beveled surfaces. The shape of the groove 2C can be expressed as a combined shape of two trapeziums, one of which is larger than the other in the Y-direction. The top face of the smaller trapezium defines the bottom 2C4 of the groove 2C.

Figure 4:
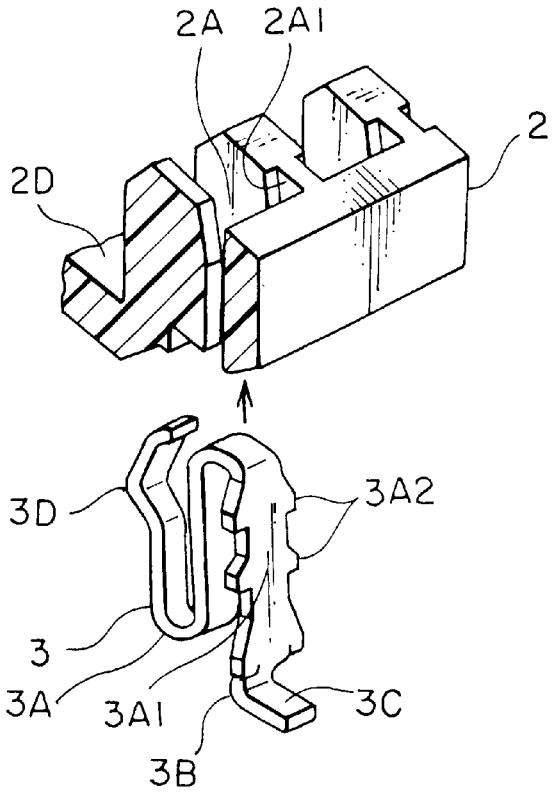
FIG. 4 is an enlarged, partial, perspective view showing the connector, especially, an insulator and a contact of FIG. 1, wherein the contact is not fit into the insulator.

As shown in FIG. 4, the insulator 2 is provided with a plurality of holes 2A, each of which has a predetermined shape including walls 2A1, such that the contact 3 can be fixedly accommodated therein. The plurality of holes 2A are arranged at intervals along both sides of each of the large slots 2D and are continuous to the corresponding one of the large slots 2D. The fixation of the contact 3 to the insulator 2 is described afterwards.

Figure 5:
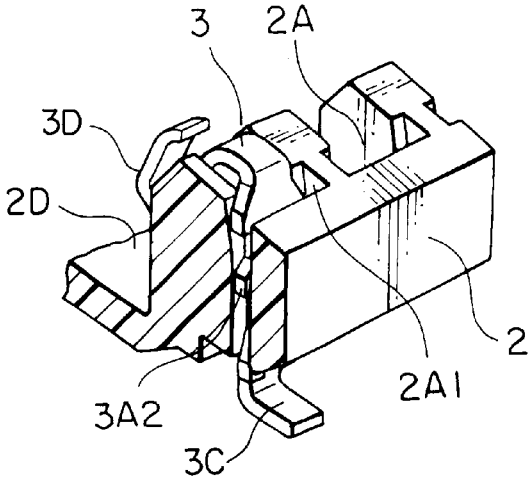
FIG. 5 is an enlarged, partial, perspective view showing the connector, especially, an insulator and a contact of FIG. 1, wherein the contact is fit into the insulator.

As shown in FIGS. 3 to 5, each of the contacts 3 has a contact portion 3D, a connection portion 3A, a curved portion 3B, and a flat terminal end portion 3C. The contact portion 3D is a portion to contact another contact of the plug connector, which is described afterwards. The connection portion 3A is an S-shaped portion and continues from the contact portion 3D. The connection portion 3A provides for the contact 3 an elastic force which forces the contact portion 3D to be securely in contact with the contact of the plug connector. The curved portion 3B continues from the connection portion 3A and is formed to project towards a side of the contact portion 3D. The flat terminal end portion 3C continues from the curved portion 3B. As seen from FIG. 4, the contact portion 3D, the connection portion 3A, the curved portion 3B, and the flat terminal end portion 3C are formed integral with each other to form a single part.

As especially shown in FIG. 4, on the both sides of a portion 3A1 of the connection portion 3A, which continues to the curved portion 3B, a plurality of projections 3A2 are provided. The projections 3A2 serve as dowels for the walls 2A1 of the hole 2A provided for the insulator 2. Therefore, when the contact 3 is pressed and inserted to the hole 2A, the projections 3A2 are forced to be fit to the walls 2A1 so that the contact 3 can be fixed to the insulator 2 (See FIG. 5) and that all of the flat terminal end portions 3C of the contacts 3 are on the same level. The contact portions 3D slightly project into the corresponding one of the large slots 2D, as shown in FIG. 3.

As especially shown in FIG. 3, the curved portions 3B and the flat terminal end portions 3C of the contacts 3, which belong to two rows nearest the side surfaces 2E, are positioned within the cut-off like shaped edges 2B. In this embodiment, the surfaces 2B2 and 2B3 of the cut-off like shaped edges 2B define a space, in which the curved portions 3B of those contacts 3 are accommodated. The flat terminal end portions 3C of those contacts 3 lie inside the side surfaces 2F in the Y-direction. The curved portions 3B of those contacts 3 are seemingly connected to the respective beveled edges 2B1 of the cut-off like shaped edges 2B, so that the beveled edges 2B1 define imaginary triangle spaces together with the respective curved portions 3B and the respective flat terminal end portions 3C.

On the other hand, the other curved portions 3B and the other flat terminal end portions 3C are positioned within the groove 2C. In this embodiment, the respective pairs of the portions 2C2 and 2C1 define spaces, respectively, in which the other curved portions 3B are accommodated. The other curved portions 3B are seemingly connected to the respective beveled portions 2C3, so that the beveled portions define imaginary triangle spaces together with the respective curved portions 3B and the respective flat end portions.

Next explanation is made of a gauge for checking whether all of the flat terminal end portions 3C in the connector 1 of this embodiment are on the same level.

Figure 6:
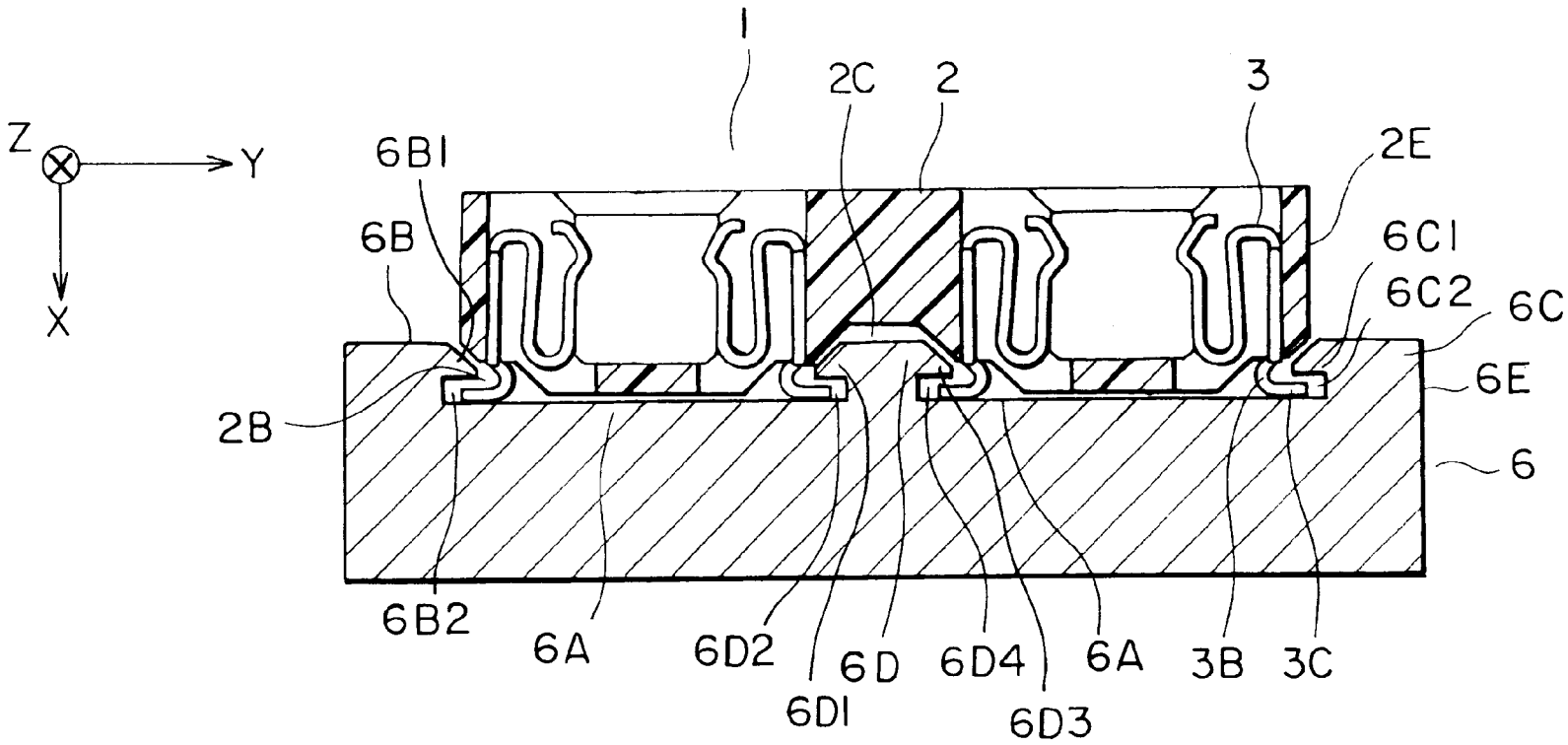
FIG. 6 is a cross-sectional view showing the connector of FIG. 1 and a gauge according to an embodiment of the present invention.

With reference to FIG. 6, the gauge 6 has an almost rectangular parallelepiped, which comprises an upper surface 6A on an upper side in the X-direction and opposite side surfaces 6E in the Y-direction. On the upper surface 6A, the connector 1 is mounted when the check is carried out. In addition, the gauge 6 comprises three projections 6B, 6C and 6D, which project from the upper surface 6A in the X-direction, corresponding to the cut-off like shaped edges 2B and the groove 2C of the connector 1.

Two projections 6B and 6C are corresponding to cut-off like shaped edges 2B and are provided at opposite sides in the Y-direction. The other 6D is corresponding to the groove 2C and is provided at an intermediate position between the opposite-side projections 6A and 6B. The opposite-side projections 6B and 6C project from the upper surface 6A in the X-direction. The opposite-side projections 6B and 6C have hook-shaped cross sections. The hook-shaped cross sections have tips, lateral protrusions or side projections 6B1 and 6C1, which go toward the inside of the opposite side surfaces 6E, respectively. The lateral protrusions 6B1 and 6C1 are provided with upper surfaces, which may incline in parallel with the beveled edges 2B1 of the cut-off like shaped edges 2B of the connector 1. The opposite-side projections 6B and 6C extend straightly in the Z-direction. The upper surface 6A and the lateral protrusions 6B1 and 6C1 of the opposite-side projections 6B and 6C define therebetween gaps or spaces 6B2 and 6C2. The gaps 6B2 and 6C2 serve to accommodate the normal flat terminal end portions 3C nearest the side surfaces 2E when the check is carried out. In other words, the gaps 6B2 and 6C2 have the same predetermined size and can be used in judgment that the connector 1 is a defective one if one of the flat terminal end portions 3C nearest the side surfaces 2E is not accommodated in the gap 6B2 or 6C2.

The other, intermediate projection 6D corresponds to the groove 2C of the connector 1 and is to be accommodated in the groove 2C when the check is carried out. The intermediate projection 6D has two hook-shaped cross-sectional portions. The hook-shaped cross-sectional portions have tips, lateral protrusions or side projections 6D1 and 6D3, which face the respective contacts 3 of the connector 1 when the check is carried out. In this embodiment, two hook-shaped cross sectional portions are formed integral with each other so that the lateral protrusions 6D1 and 6D3 go toward different orientations from each other or extend in directions opposite to each other in the Y-direction. The lateral protrusions 6D1 and 6D3 have upper surfaces, which may incline in parallel with the beveled portions 2C3 of the groove 2C. In other words, the intermediate projection 6D of this embodiment has a cross-section of an umbrella-like shape or a mushroom-like shape. The intermediate projection 6D extend straightly in the Z direction. The upper surface 6A and the lateral protrusion 6D1 and 6D3 define therebetween gaps or spaces 6D2 and 6D4. The gaps 6D2 and 6D4 serve to accommodate the normal flat terminal end portions 3C except ones nearest the side surfaces 2E when the check is carried out. In other words, the gaps 6D2 and 6D4 have the same predetermined size as the gaps 6B2 and 6C2 and are used in judgment that the connector 1 is a defective one if one of the flat end portions except ones nearest the side surfaces 2E is not accommodated in the gap 6B2 or 6C2.

Next explanation is made of a method of checking whether all flat terminal end portions 3C of the contacts 3 in the connector 1 are on the same level.

As shown in FIG. 6, when the check is carried out, the flat terminal end portions 3C positioned at a first side of the connector 1 in the Z-direction are inserted into the respective gaps 6B2, 6C2, 6D2 and 6D4 of the gauge 6. At that time, the flat terminal end portions 3C inserted into the gaps 6B2, 6C2, 6D2 and 6D4 are in contact with or near the upper surface 6A of the gauge 6. There are gaps between the beveled edges 2B1 and the lateral protrusions 6B1 of the opposite-side projections 6B and 6C, respectively. There are also gaps between the beveled portions 2C3 and the lateral protrusions 6D1 and 6D3 of the intermediate projection 6D, respectively. The lateral protrusions 6B1 and 6C1 of the opposite-side projections 6B and 6C are accommodated in the imaginary triangle spaces which are defined by the beveled edges 2B1 and the respective curved portions 3B and the respective flat terminal end portions 3C. The lateral protrusions 6D1 and 6D3 of the intermediate projection 6D are accommodated in the imaginary triangle spaces which are defined by the beveled portions 2C3 and the respective curved portions 3B and the respective flat terminal end portions 3C.

When the connector 1 is slid on the gauge 6 in the Z-direction, more flat terminal end portions 3C are inserted into the respective gaps 6B2, 6C2, 6D2 and 6D4. At that time, the connector 1 is also allowed to move in the X- and Y-directions because there are many gaps as mentioned above. If one of the flat terminal end portions 3C is bent or deformed so that the connector 1 is made defective, the flat terminal end portion 3C can not be smoothly inserted into the corresponding one of gaps 6B2, 6C2, 6D2 and 6D4 but collides with the corresponding one of side projections 6B1, 6C1, 6D1 and 6D3. Otherwise, it can be judged that all of the flat terminal end portions 3C are on the same level substantially. Thus, the check is easily carried out by the use of the gauge 6.

In this embodiment, the number of rows of the contacts 3 is four. However, the number of the rows is not restricted to four but may be three, five or more.

For reference sake, next explanation is made about an example of a plug connector which is mated with the receptacle connector 1 of FIG. 1.

Figure 7:
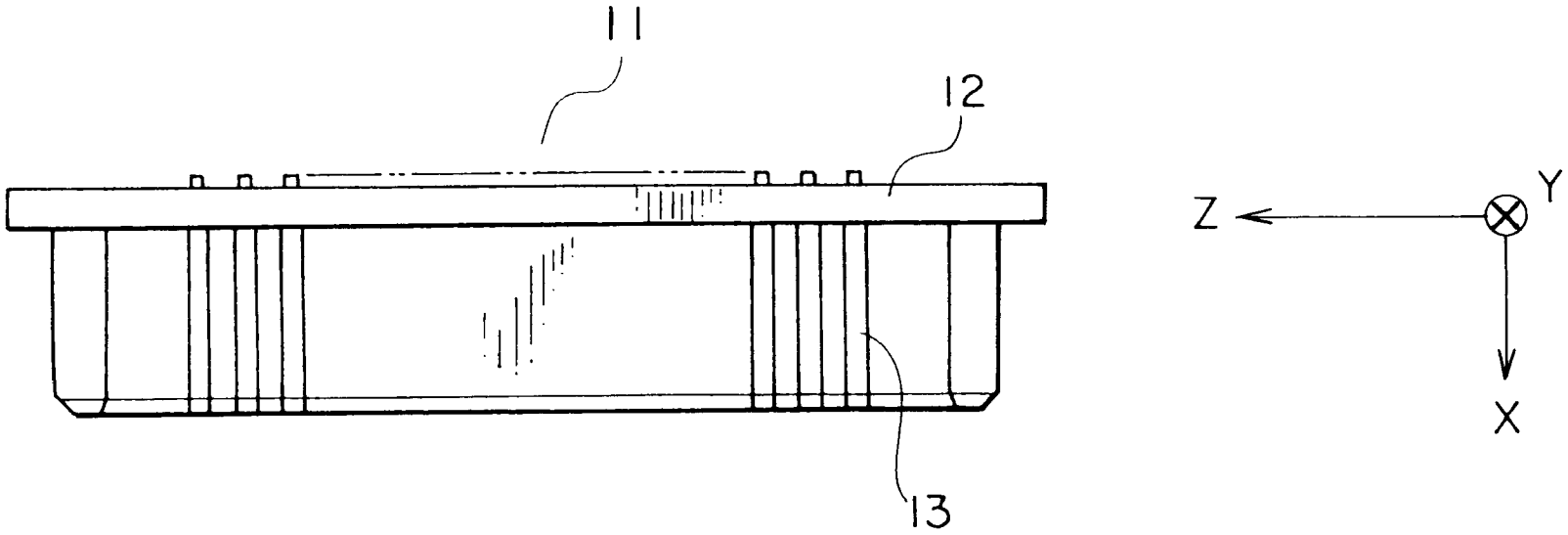
FIG. 7 is a side view showing a plug connector, which is a mating connector for the connector of FIG. 1.
Figure 8:
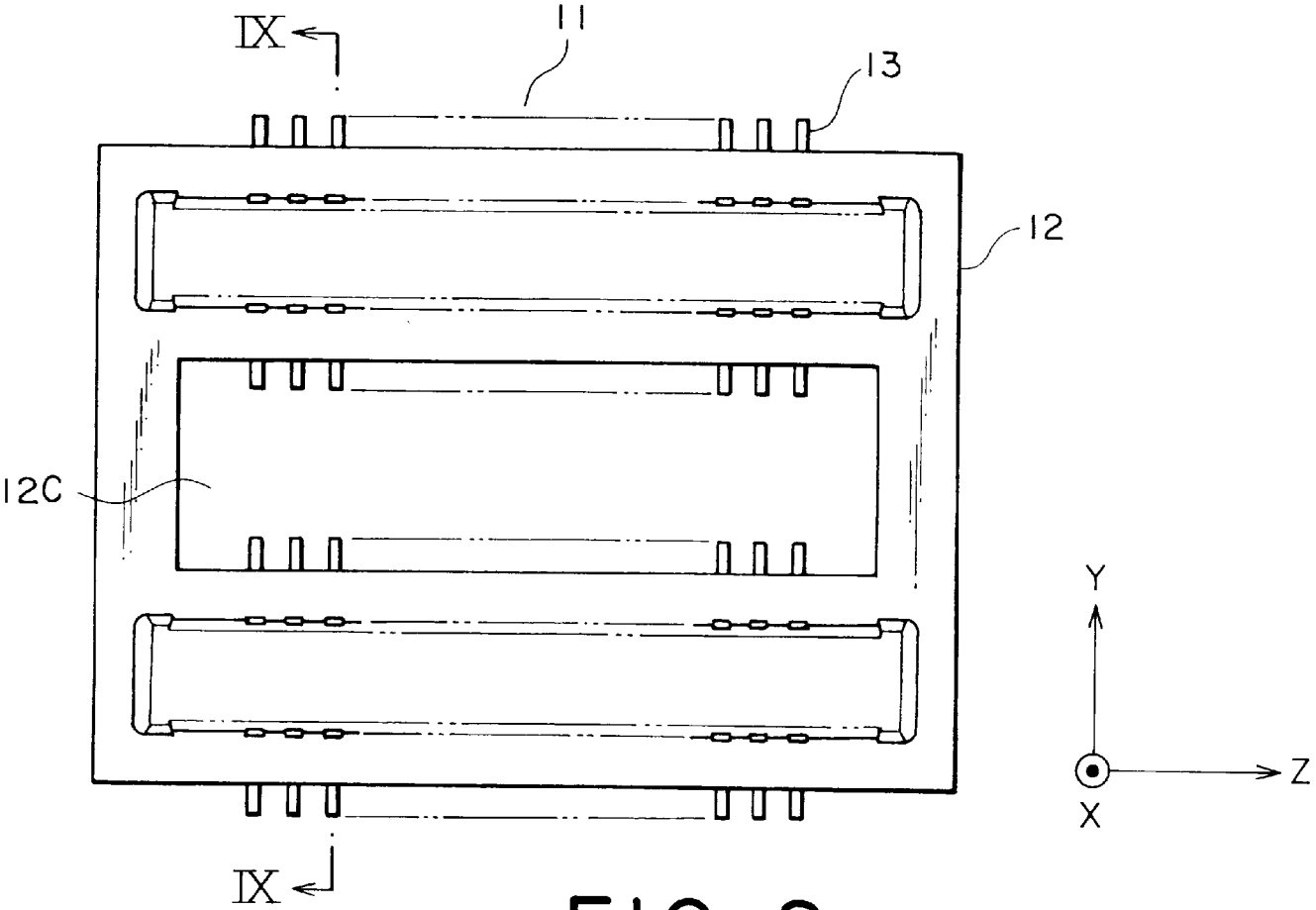
FIG. 8 is a bottom plan view showing the connector of FIG. 7.
Figure 9:
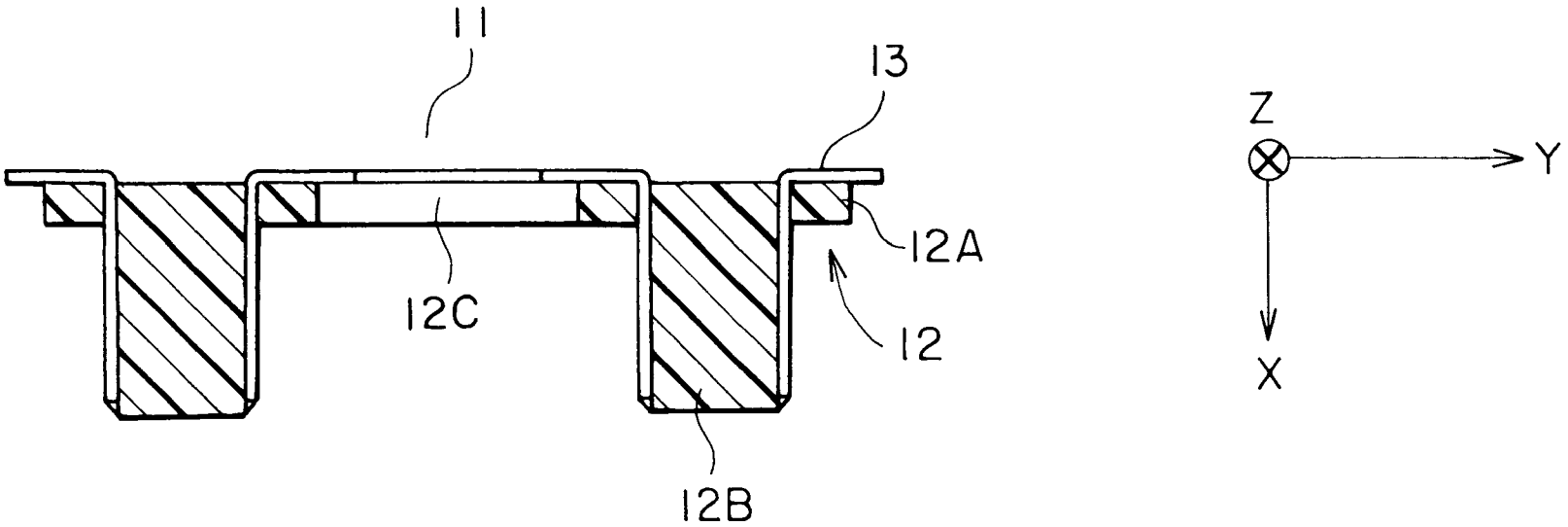
FIG. 9 is a cross sectional view showing the connector taken along lines IX—IX of FIG. 8.

With reference to FIGS. 7 to 9, the plug connector 11 comprises an insulator 12 and a plurality of contacts 13, each of which has a L-like shape. The insulator 12 has a base portion 12A and two supports 12B. The base portion 12A has a thin plate of a rectangular shape and is provided with a rectangular opening 12C on the center thereof, as especially shown in FIG. 8. The supports 12B are positioned so that the opening 12C is arranged therebetween. Each of the supports 12B extends in the Z-direction and projects from the base portion 12A downwardly in the X-direction. One edge of each contact 13 is fixed on an upper surface of the base portion 12A in the X-direction, while the other edge of each contact 13 is fixed on a side surface of a corresponding one of the supports 12B. In detail, a pair of the contacts 13 are symmetrically arranged on opposite sides of the same support 12B in the Y-direction. The contacts 13 are arranged in four rows. When the two supports 12B are inserted into the two large slots 2D, respectively, so that plug connector 11 is fit to the receptacle connector 1, the contacts 13 are in contact with the respective contacts 3.

What is claimed is:

1. A connector (1) comprising:

an insulator (2) in a shape of a rectangular parallelepiped having a lower surface (2F) on a lower side in a first direction and two side surfaces (2E) in a second direction perpendicular to the first direction, the insulator (2) having two cut-off like shaped edges (2B) on the lower side in the first direction and on both sides in the second direction, and further having at least one groove (2C) on the lower surface (2F), the cutoff like shaped edges (2B) and the at least one groove (2C) straightly extending in a third direction perpendicular to the first and second direction; and three or more rows of contacts (3) fixedly mounted on the insulator, each of the contacts (3) having a contact portion (3D), a connection portion (3A), which continues from the contact portion (3D), a curved portion (3B), which continues from the connection portion (3A) and projects towards a side of the contact portion (3D), and a flat terminal end portion (3C), which continues from the curved portion (3B), wherein the flat terminal end portions (3C) of the contacts (3) are on the same level, and the curved portions (3B) and the flat terminal end portions (3C) of the contacts (3), which belong to two rows nearest the side surfaces (2E), are positioned within the cut-off like shaped edges (2B), while the other curved portions (3B) and the other flat terminal end portions (3C) are positioned within the at least one groove.

2. The connector (1) according to claim 1, wherein the flat terminal end portions (3C) of the contacts (3), which belong to the two rows nearest the side surfaces (2E), lie inside the side surfaces (2E) in the second direction.

3. The connector (1) according to claim 1, wherein each of the cut-off like shaped edges (2B) has at least one beveled edge (2B1), which extends from a corresponding one of the side surfaces (2E) toward corresponding ones of the curved portions (3B), and the at least one groove (2C) has a bottom (2C4) and at least one beveled portion (2C3), which extends from the bottom (2C4) toward corresponding ones of the curved portions (3B).

4. The connector (1) according to claim 3, wherein the beveled edges (2B1) of the cut-off like shaped edges (2B) and the beveled portion (2C3) define imaginary triangle spaces together with the respective curved portions (3B) and the respective flat terminal end portions (3C).

5. The connector (1) according to claim 4, wherein:

each of the cut-off like shaped edges (2B) further has a first surface (2B2), which continues from the beveled edge (2B1) and is parallel to the lower surface (2F), and a second surface (2B3), which connects between the first surface (2B2) and the lower surface (2F);

the first and second surfaces (2B2, 2B3) define a space to accommodate corresponding ones of the curved portions (3B);

the at least one groove (2C) further has a first portion (2C2), which continues from the beveled portion (2C3) and is parallel to the lower surface (2F), and a second portion (2C1), which connects between the first portion (2C2) and the lower surface (2F); and the first and second portions (2C2, 2C1) define a space to accommodate corresponding ones of the curved portions (3B).

6. A gauge (6) for checking whether the flat terminal end portions (3C) in the connector (1) according to any one of claims 1 to 5 are on the same level, comprising:

an upper surface (6A) on an upper side in the first direction, on which the connector is mounted during the check;

opposite side surfaces 6E in the second direction;

opposite-side projections (6B, 6C) provided on the upper surface (6A) at opposite sides in the second direction and projecting from the upper surface (6A) in the first direction, the opposite-side projections (6B, 6C) having hook-shaped cross sections which have lateral protrusions (6B1, 6C1) which go toward the inside of the opposite side surfaces (6E), respectively; and at least one intermediate projection (6D) provided on the upper surface (6A) at an intermediate position between the opposite-side projections (6B, 6C) and projecting from an upper surface (6A) in the first direction, the at least one intermediate projection (6D) corresponding to the at least one groove (2C) and having at least one hook-shaped cross-sectional portion which has a lateral protrusion (6D1, 6D3) which faces the respective contacts (3) when the check is carried out;

wherein:

the opposite-side projections (6B, 6C) and the at least one intermediate projection (6D) extend straightly in the third direction;

gaps (6B2, 6C2), which are defined by the upper surface (6A) and the side projections (6B1, 6C1) of the opposite-side projections (6B, 6C), are for accommodating the flat terminal end portions (3C) nearest the side surfaces (2E) of the connector (1) when the check is carried out;

another gap (6D2, 6D4), which is defined by the upper surface (6A) and the lateral projection (6D1, 6D3) of the at least one intermediate projection (6D), is for accommodating corresponding ones of the flat terminal end portions (3C) when the check is carried out; and the at least one intermediate projection (6D) is to be accommodated in the at least one groove (2C) of the connector (1) when the check is carried out.

* * * * *